US010801712B2

(12) United States Patent
Wu et al.

(10) Patent No.: US 10,801,712 B2
(45) **Date of Patent: *Oct. 13, 2020**

(54) LED LIGHTING APPARATUS

(71) Applicant: XIAMEN ECO LIGHTING CO. LTD., Xiamen (CN)

(72) Inventors: Chenjun Wu, Xiamen (CN); Hongkui Jiang, Xiamen (CN); Yanzeng Gao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/785,203

(22) Filed: Feb. 7, 2020

(65) Prior Publication Data

US 2020/0173641 A1 Jun. 4, 2020

Related U.S. Application Data

(63) Continuation of application No. 15/961,493, filed on Apr. 24, 2018.

(51) Int. Cl.

| | |
|---|---|
| ***F21V 29/503*** | (2015.01) |
| ***F21V 29/506*** | (2015.01) |
| ***F21V 29/508*** | (2015.01) |
| ***F21V 29/70*** | (2015.01) |
| ***F21K 9/66*** | (2016.01) |
| ***F21K 9/232*** | (2016.01) |
| ***F21K 9/235*** | (2016.01) |
| ***F21V 23/00*** | (2015.01) |
| ***F21K 9/238*** | (2016.01) |
| ***F21Y 115/10*** | (2016.01) |

(52) U.S. Cl.

CPC ..... *F21V 29/503* (2015.01); *F21K 9/232* (2016.08); *F21K 9/235* (2016.08); *F21K 9/238* (2016.08); *F21K 9/66* (2016.08); *F21V 23/001* (2013.01); *F21V 23/003* (2013.01); *F21V 29/506* (2015.01); *F21V 29/508* (2015.01); *F21V 29/70* (2015.01); *F21Y 2115/10* (2016.08)

(58) Field of Classification Search

CPC ..... F21K 9/235; F21K 9/237; F21K 9/238

See application file for complete search history.

(56) References Cited

U.S. PATENT DOCUMENTS 7,581,965 B1 * 9/2009 Upasani ..... H05K 3/32 439/82

8,523,411 B2 * 9/2013 Kawagoe ..... F21V 5/007 362/373

(Continued)

*Primary Examiner* — Alexander K Garlen

(74) *Attorney, Agent, or Firm* — Chun-Ming Shih; Lanway IPR Services

(57) ABSTRACT

A LED filament bulb apparatus includes a bulb shell, one or more LED strips, a core column, two pluggable sockets, a driver board and a cap. The LED strip is electrically connected to two power lead wires. The core column supports the LED strip. The two power lead wires have bottom ends. The two pluggable sockets respectively receives the two bottom ends. The driver board is used for mounting the two pluggable socket and a driver circuit. The two bottom ends of the two power lead wires are electrically connected to the driver circuit for receiving a driving current generated by the driver circuit from converting an external power source. The cap is fixed to the core column and the bulb shell.

19 Claims, 8 Drawing Sheets

(56) References Cited

U.S. PATENT DOCUMENTS

| | | | | |
|---|---|---|---|---|
| 2012/0206921 | A1* | 8/2012 | Chang | F21K 9/00 362/311.02 |
| 2013/0215625 | A1* | 8/2013 | Takeuchi | F21V 23/001 362/363 |
| 2015/0055354 | A1* | 2/2015 | Mueller | F21K 9/23 362/373 |
| 2015/0345766 | A1* | 12/2015 | Wang | F21V 23/00 362/382 |
| 2017/0108203 | A1* | 4/2017 | Habchi | F21V 23/009 |

* cited by examiner

LED LIGHTING APPARATUS

RELATED APPLICATION

The present application is a continued application of U.S. patent application Ser. No. 15/961,493.

FIELD OF INVENTION

The present invention is related to a LED bulb apparatus and more particularly related to LED filament bulb apparatus.

BACKGROUND

Lighting is an important part of human life. Since Thomas Edison has invented electric lighting, the life of human being was widely changed. With the improvement in LED (Light emitting diode) technology and the decrease in cost, LED technology rapidly extends to various light fixtures and applications.

Compared with traditional incandescent light bulbs, LED usually has better luminous efficacy. However, LED components have limitations in heat resistance. If the problems of heat dissipation can be solved effectively, the life span of LED and the stability of light fixtures would be greatly improved.

Light bulbs are an important part of a light fixture. Because light bulbs are used for a long period, people have given impressions and preferences of the shape of light bulbs. Currently there are LED light bulbs designed to resemble traditional incandescent light bulbs in the market. However, the production process of LED light bulbs similar to incandescent light bulbs in appearance often faces the problems of weak structures and complicate assembly.

The present invention focuses on the technical problems of these kind of light bulbs. The present invention shows improvements in cost, reliability of products, and production cost.

SUMMARY OF INVENTION

According to an embodiment of the present invention, a LED filament bulb apparatus has a bulb shell, at least one LED strip, a core column, two pluggable sockets, a driver board and a cap.

The at least one LED strip is mounted with a LED module. In some embodiments, there is only LED strip and in some other embodiments, there are two or more than two LED strips. Each LED strip may have a substrate, which may be transparent for emitting wide angle light, and multiple LED chips disposed on the substrate connected in series or in other manner, two electrode disposed at two ends of the substrate for supplying a driving current to the LED chips. The substrate may have an elongated shape. The substrate may be transparent, rigid or flexible.

There are various ways to arrange the LED strips. For example, multiple LED strips are arranged as a three-dimension structure in different planes to emit wide angles in a three-dimension space. A metal bar or a pillar may be fixed on the core column extended upwardly to support top ends of the LED strips. Alternatively, a bracket made of metal, glass or plastic material may be fixed on the core column to support the LED strips.

The LED strips may be connected in series or in parallel as a LED strip set. In some other embodiments, the LED strips are divided into two more independent LED strip sets, e.g. for different colors or different color temperatures. In such case, each LED strip set may have its own two power lead wires. In other words, there may be more than two power lead wires disposed in a LED bulb apparatus.

The driver circuit may have corresponding driving modules controlling and serving corresponding LED strip sets. For example, two LED strips with different color temperatures may be supplied with varied combinations of driving current to mix different overall color temperature of the LED bulb apparatus.

The LED strip is directly or indirectly electrically connected to two power lead wires. If there is only LED strip, two ends of the LED strip are connected to the two power lead wires. If there are more than two LED strips, the LED strips are still indirectly electrically connected to the two power lead to receive power supply.

As mentioned above, there may be multiple LED strip sets, and each LED strip may have its own LED power lead wires.

The core column supports the LED strip. The core column is fixed with the bulb shell forming a chamber for containing the LED strip. The two power lead wires have embedded parts embedded in the core column and having bottom ends exposed outside the core column.

The two pluggable sockets respectively receive thus are connected to the two bottom ends of the two power lead wires.

The driver board is used for mounting the two pluggable socket and a driver circuit. The two bottom ends of the two power lead wires are electrically connected to the driver circuit for receiving a driving current generated by the driver circuit from converting an external power source.

The cap is fixed to the core column and the bulb shell has two external electrodes for connecting input of the external power source. For example, the cap is corresponding to a standard Edison bulb socket. When the LED bulb apparatus is screwed into an Edison socket connected to a 110V or 220V power supply, the external power is converted to a driving current sent to the LED strip via the socket and the bottom ends of the power lead wires.

In some embodiments, the pluggable socket is made by folding a metal sheet to form an elastic receiver part and a base part. The base part is structurally fixed on the driver board. The pluggable socket is electrically connected to the driver circuit. The elastic receiver parts respectively clip the bottom ends of the power lead wires. In other words, the driving current is transmitted via the driver circuit, the elastic receiver part of the socket, the bottom end and then to the LED strip.

The elastic receiver parts have elastic force due to material characteristic and structure shape to keep touching and thus electrically connected to the bottom ends of the power lead wires. For example, the elastic receiver parts may be two arms with top ends kept close, providing an entrance for inserting the bottom end of the power lead wire. When the power lead wire is inserted though the entrance, the two arms are stretched and form an elastic force to clip the bottom end of the power lead wire.

The surface of the bottom end and the two arms may be processed to increase better contact and to prevent loose of connection.

When the sheet is folded, the sheet becomes a box shape with two arms mentioned above and four feet to stand and to fix to the circuit board. All four feet may be fixed on the driver board with welding or glue. In addition, circuit terminals are electrically connected to the one or more feet to keep the inserted bottom end of the power lead wire electrically connected to the driver circuit.

Furthermore, in some embodiments, the receiver part of the socket may have an entrance track with a top opening, where the bottom end of the power lead wire is entered. The top opening is kept wider than a lower part of the entrance track for guiding the bottom ends entering the entrance track. When the bottom end of the power lead wire has entered the opening, the bottom end of the power lead wire meets a narrower space and finally is clip and fixed in the socket.

Furthermore, in some embodiments, the entrance track has a tilt angle to help fix the bottom end of the power lead wire. In other words, during the insertion of the bottom end of the power lead wire into the socket, part of the bottom end of the power lead wire is bent, which helps increase robust fixing effect between the socket and the bottom end of the power lead wire.

In some embodiments, the receiver part is a pair of elastic clip structures, just like a scissor structure to clip and thus fix the bottom end of the power lead wire.

In some embodiments, the pair of elastic clip structures respectively have extended top structures respectively to increase a top operation area of the socket. With such design, particularly during automatic manufacturing processing, the sockets are easier to be operated by a manufacturing robot and thus the socket may occupy even less size, which may save more cost and decrease manufacturing difficulty, e.g. using less expensive robots to manufacturing such LED bulbs.

In some embodiments, the bottom end of the power lead wire has a first hook structure and the socket has a corresponding second hook structure. When the bottom end of the power lead wire is inserted into a predetermined position of the socket, the first hook structure is hooked with the second hook structure to stabilize connection of the bottom end of the power lead wire and the socket.

For example, the bottom end of the power lead wire may have a protruding block as the first hook structure, which is corresponding a cavity on the socket as the second hook structure. When the protruding block of the bottom end of the power lead wire meets the cavity, the protruding block is kept in the cavity unless an extra external force is applied to escape the protruding block away from the cavity of the socket.

Such corresponding hook structures may be varied to other structures, like a ring to a protruding block or any other structures at a specific position where the bottom end and the socket are expected to be fixed together.

In some embodiments, the core column and the bulb shell are firstly fixed together to form a shell module. The shell module has a bottom surface, and the power lead wires are extended beyond the bottom surface of the shell module with more than 5 mm. In other words, the bottom ends has a protruding portion with respect to the bottom surface of the shell module.

Furthermore, in such case, the driver board may engage the bottom surface after the power wires are inserted into the sockets of the driver board. In other words, the protruding portion of the power lead wires with respect to the bottom surface of the shell module is entered into the socket and stopped when the driver board touches the bottom surface of the shell module.

In some embodiments, the core column and the bulb shell are made of glass material and the core column has an exhaust tube for filling heat dissipation gas into a sealed chamber of the bulb shell and the core column. The heat dissipation gas may be $H_2$, He, $O_2$ and the air pressure may be between 10 Torr to 2000 Torr. There are various glass materials and some are harder than others.

In some embodiments, the power lead wire also includes an interface unit with the two bottom ends extended from a bottom side of the interface unit. The interface unit is placed under the core column.

There are several cases for designing the interface unit. For example, the interface unit may include a plastic body, so that a part of the power lead wire is inserted into the plastic body and positioned by the plastic body so that the two bottom ends of the power lead wires are aligned with the two corresponding sockets on the driver board. In some other examples, the interface unit may further have two metal electrode pins as the two bottom ends mentioned above that are electrically connected and structured connected to the other portion of the power lead wires. Specifically, the power lead wire may be flexible and difficult to insert into the socket directly. By connecting the power lead wire with a pin as the bottom end of the power lead wire, it would be easier to align and to assemble these components together, saving manufacturing difficulty and increasing manufacturing speed.

Furthermore, the interface unit may be a hub for collecting more than two power lead wires with a common output as the bottom end mentioned above. Such arrangement also enhances design convenience for building a more complicated combination of LED strips to meet different LED bulb requirements.

In some embodiments, the interface unit may also be used for keeping the two bottom ends with a predetermined distance to be plugged into the two sockets. Compared with directing inserting the power lead wires into the socket, placing an interface unit with a plastic body or other material, specifically having certain aligning or positioning structures with respect to the cap or the shell module, would help the overall assembling and structure more stable.

In some other embodiments, the sockets may have two sliding tracks for the two bottom ends to insert by rotation the driver board with respect to the interface unit. For example, the bottom ends are inserted into the sliding tracks by rotating the cap with respect to the shell module to fix the bottom ends of the power lead wires to the sockets of the driver board.

In some embodiments, the driver board has two through holes and the two bottom ends are inserted through the two through holes to reach the two sockets. In other words, the sockets are placed at the opposite side of the driver board with respect to the side facing to the core column.

In some embodiments, the two sockets are made as a module to be fixed on the driver board. For example, the two sockets may be made of folded metal sheet and then molded into a plastic unit. The plastic unit is fixed to a corresponding structure on the driver board to fix the sockets on the driver board. Further electricity connection may be made by welding mud or by contacting the socket directly with electrode terminals of the driver circuit with the plastic unit.

In some embodiments, the core column and the bulb shell form a shell module. The cap, the driver board and the shell module are fixed together with a welding mud. The welding mud is firstly mixed with some solution like alcohol liquid and then the LED bulb is heated to remove such solution to fix the cap, the driver board and the shell module together.

Furthermore, the welding mud is applied so as to connect the driver board with the cap and the shell module to transmit heat for performing better heat dissipation. Specifically, a part of the welding mud is clipping and holding the edge of the driver board to take heat of the driver board to other place.

In some embodiments, there are more than two power lead wires, and a portion of the power lead wires are twisted together to enter the same socket. In some design, the power lead wires are twisted or connected in the core column. In some other design, the power lead wires are twisted or connected at the bottom ends of the power lead wires. As mentioned above, there may be multiple LED strips forming multiple LED strip sets. Under certain combination of the LED strips, some power lead wires electrically connected to the same terminal in a circuit diagram may be twisted first. The twisted wires, in some socket, may be easier and provide a better fixing effect to be connect to the socket.

In some embodiments, the driver board have a metal pattern not connected to the driver circuit for enhance heat dissipation. In other words, when manufacturing the driver board using common circuit board material. Some patterns of metal parts, not part of the driver circuit, may be placed specifically for enhancing heat dissipation.

In some embodiments, a circuit component of the driver board that generates most heat is placed on a bottom side of the driver board opposite to a top side facing to the core column. For example, the power IC or bridge circuit may be placed on the bottom side. In such arrangement, the heat is prevented from the LED strip and also the cap helps preventing electro-magnetic wave escape outside the LED bulb.

In some other designs, when the circuit components of the driver circuit are the major heat source, the circuit components are placed on both sides of the driver board. In some design, the connection between the core column and the driver board also helps bring heat generates by the driver circuit to other places of the LED bulb to perform heat dissipation.

DETAILED DESCRIPTION

Figure 1:
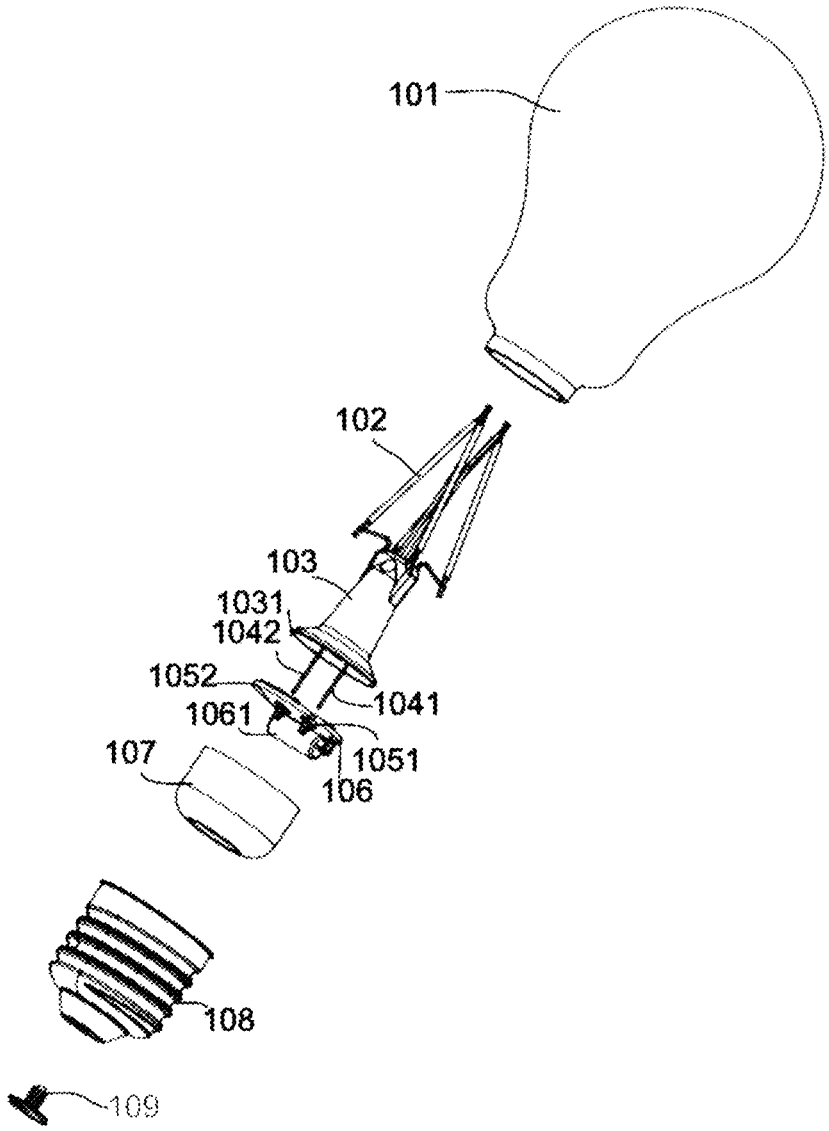
FIG. 1 is an exploded view of an embodiment of a LED bulb apparatus.

Please refer to FIG. 1. FIG. 1 is an exploded view of an embodiment of a LED bulb apparatus.

In FIG. 1, the LED bulb apparatus has a bulb shell 101, four LED strips 102, a core column 103, two power lead wires 1041, 1042, a driver board 106, two sockets 1051, 1052, a heat sink 107, a cap 108 and a cap electrode 109.

The cap 108 has a metal surface that is insulated from the cap electrode 109 for receiving an external power source like 110V or 220V by installing the cap and the cap electrode 109 in an Edison socket. Please be noted that the Edison socket is only for example, not to limit the invention scope.

The heat sink 107 is a cup shape in this example, with one side contact with the cap 108 and the other side for receiving heat from the driver board or the LED strips 102.

The LED strips 102 are connected in series, in parallel or in any combination. To provide power supply to the LED strips 102, the LED strips 102 directly or indirectly connected to two power lead wires 1041, 1042 with a portion embedded in the core column 103. The total number of the power lead wires may be more when there are more set of LED strips that need to be operated independently. Two power lead wires 1041, 1042 are used here for providing an example, not to limit the invention scope.

The bulb shell 101 and the core column 103, in this example, are made of the same glass material. During manufacturing, the power lead wires 1041, 1042 are firstly put in a molding device, liquid glass material is then filled in the molding device and when the liquid glass material is hardened, a portion of the power lead wires 1041, 1042 are embedded in the core column 103.

The LED strips are then connected to the power lead wires 1041, 1042, and certain support structures may be used for spreading the LED strips 102 to keep at predetermined position. Then, the bulb shell 101 is fixed to the core column 103 with heating. When the bulb shell 101 and the core column 103 are made of the same glass material, they are fixed together robustly to form a chamber. An exhaust tube may be provided on the core column for inserting gas like $H_2$, He, $O_2$, or mixed combination, into the chamber. After the gas is filled, the exhaust tube may be heated to close the gas path so as to form a sealed chamber.

The power lead wires 1041, 1042 have bottom ends exposed outside the core column 103 and the two bottom ends are inserted into two corresponding sockets 1051, 1052. In this example, the driver board 106 have two corresponding through holes for the bottom ends of the power lead wires 1041, 1042 to insert to reach the sockets 1051, 1052.

The sockets 1051, 1052 have certain elastic force to hold the bottom ends of the power lead wires 1051, 1052. The sockets 1051, 1052 also have electrical connection to a driver circuit 1061 on the driver board 106 so that when the bottom ends of the power lead wires 1051, 1052 are inserted into the sockets 1051, 1052, the LED strips 102 receive a driving current generated by the driver circuit 1061 from converting the external power source via the cap 108 and the cap electrode 109.

Figure 2:
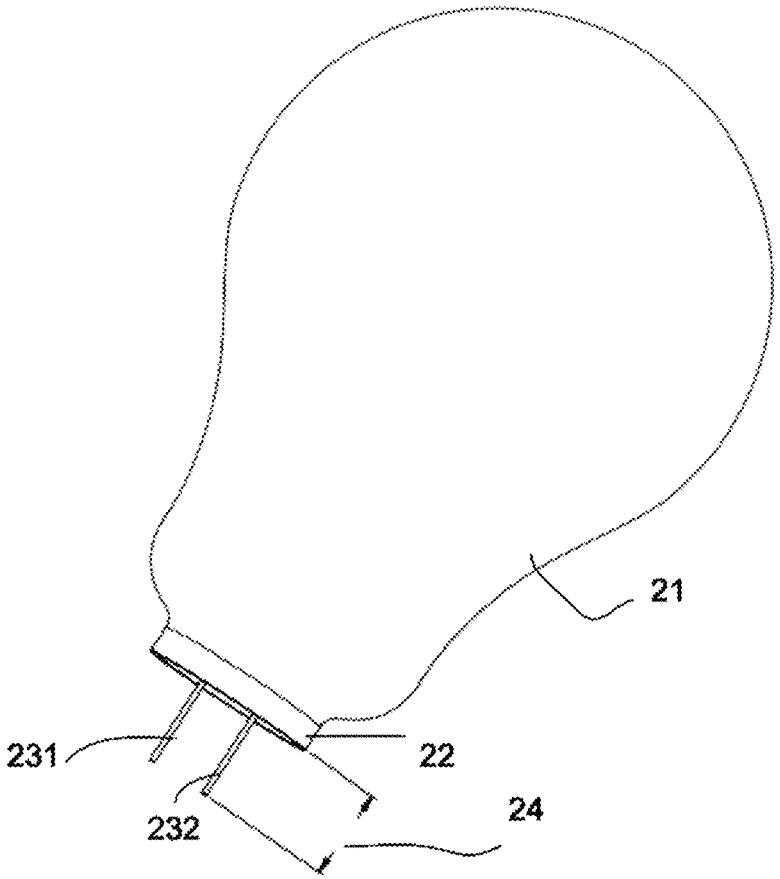
FIG. 2 illustrates a shell module and two bottom ends of power lead wires extended from the shell module.

Please refer to FIG. 2. FIG. 2 illustrates a shell module and two bottom ends of power lead wires extended from the shell module 21 composed of the bulb shell and the core column as mentioned above. The shell module 21 has a bottom surface 22 at one end of the shell module 21. The power lead wires have two bottom ends 231, 232 protruding from the bottom surface 22 with a distance, like 5 mm or more in this example.

Figure 3:
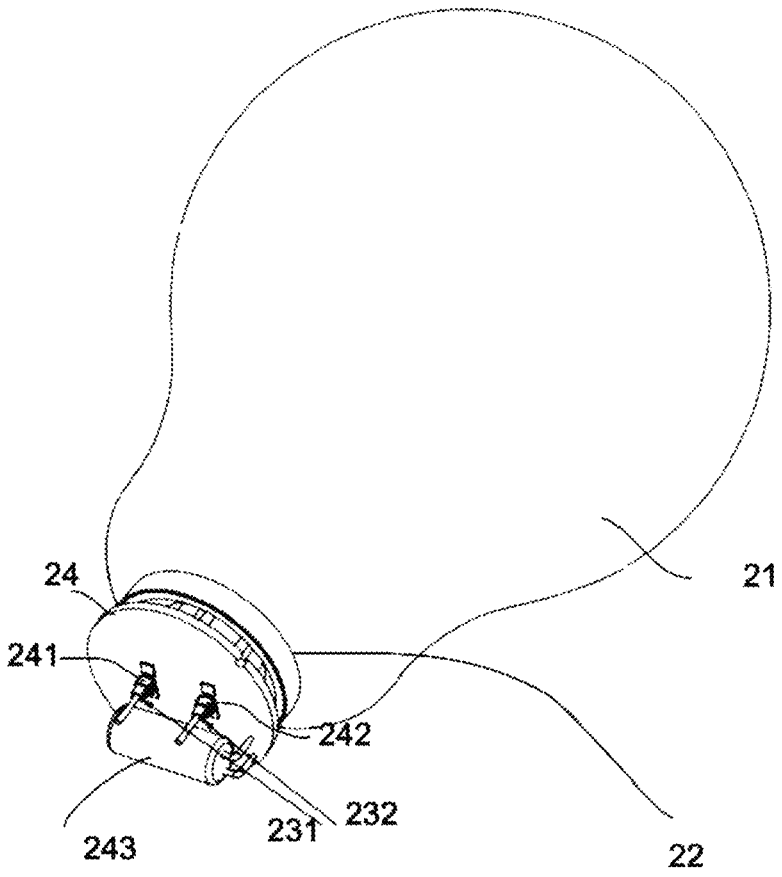
FIG. 3 illustrates a driver board attached to a shell module.

Please refer to FIG. 3. FIG. 3 illustrates a driver board 24 attached to a shell module 21 in another view angle. In addition, the driver board 24 is illustrated to connect to the shell module 21. The same reference numerals represent the same component shown in FIG. 2.

In FIG. 3, the bottom ends 231, 232 are inserted from a top side of the driver board 24 and penetrate to another side of the driver board 24, into the sockets 241, 242. In this example, the driver board 24 has some components 243 with large volume and are placed at the bottom side of the driver board 24.

In some design, it would be preferable to keep the component generating most heat away from the LED strips, to prevent damages due to exposure the LED strips in high temperature environment for long time. In such case, the component that generates most heat is placed at bottom side of the driver board 24, as illustrated in FIG. 3.

In some other design, it would be preferable to emphasize heat dissipation of the driver board 24. In such case, the component generating most heat is placed at top side of the driver board 24, facing to the shell module 21. As mentioned above, the shell module 21 may be filled with heat dissipation gas, thus forming a nice heat dissipation device.

Figure 4A:
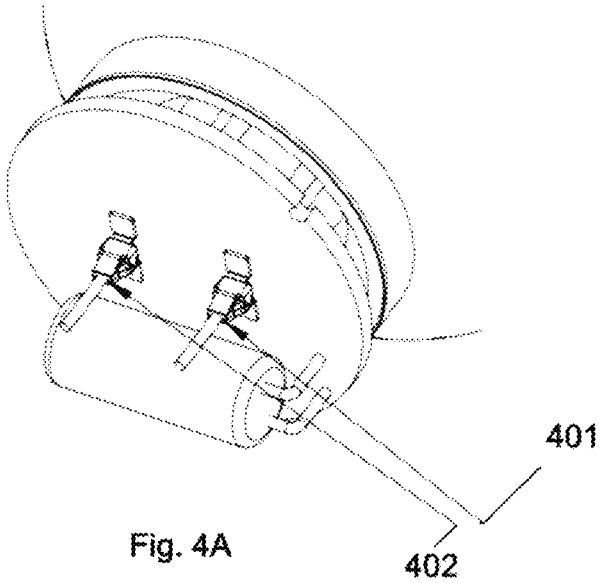
FIG. 4A illustrates a first type of a socket example.
Figure 4B:
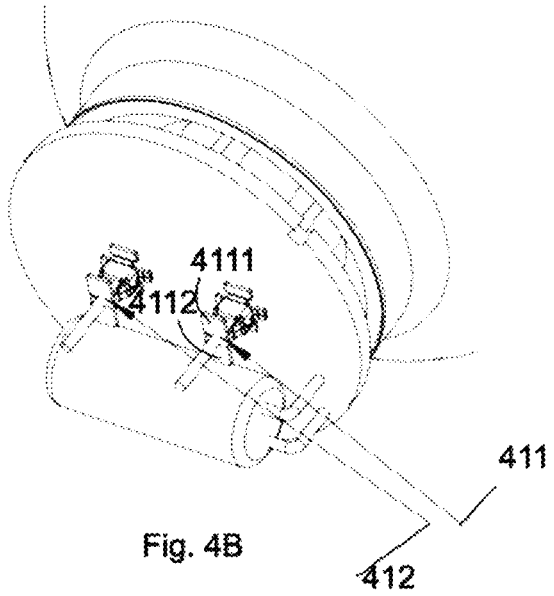
FIG. 4B illustrates a second type of a socket example.

Next, please refer to FIG. 4A and FIG. 4B. FIG. 4A illustrates a first type of a socket example. FIG. 4B illustrates a second type of a socket example.

In the enlarged diagrams, two designs of similar sockets are shown. In FIG. 4A, the sockets 401, 402 have two arms to clip the inserted bottom ends of power lead wires. It is shown in FIG. 4A that the socket may be made by folding a metal sheet to form a three dimension structure with a base part and a receiver part. The receiver part, in this example, is the two clipping arms. The base part has four feet to fix on the driver board.

In FIG. 4B, it is shown extended top structures 4111, 4112 on top of the receiver part 411. With such design, the sockets may be made even smaller but keeping the top structures 4111, 4112 to be easily operated by an automatic robot.

Figure 5:
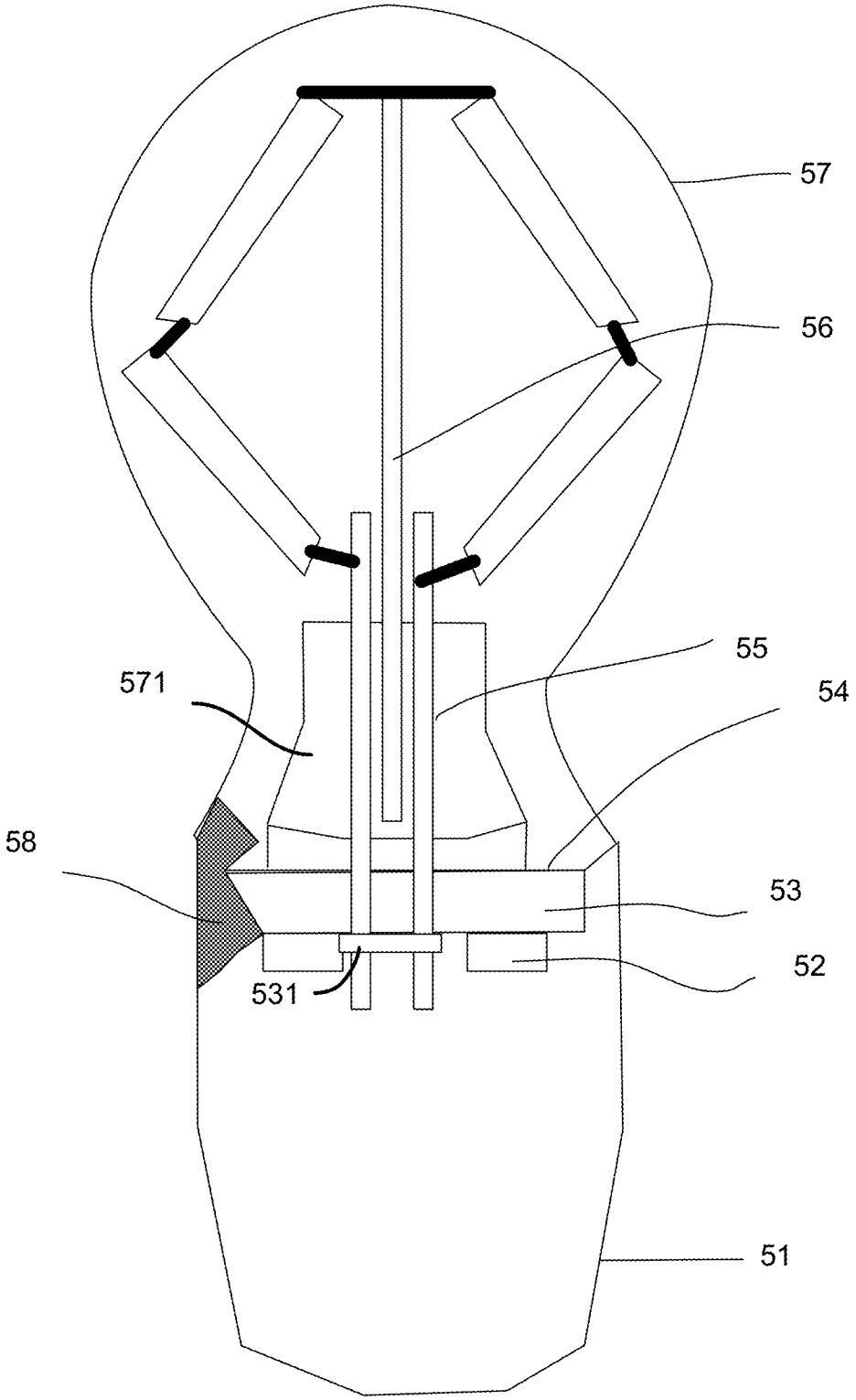
FIG. 5 illustrates several concept of the present invention.

Please refer to FIG. 5. FIG. 5 illustrates several concepts of the present invention.

In FIG. 5, the exemplary LED bulb apparatus has a bulb shell 57. The bulb shell 57 is fixed to a core column 571. Two power lead wires 55 are fixed partly in the core column 571. The power lead wires 55 have two bottom ends inserted into a socket module 531 that integrates the two sockets mentioned above as a unit. Multiple LED strips are supported and connected to the central support 56 fixed on the core column 571 and the power lead wires 55. The welding mud 58 is used for fixing the bulb shell 57, the driver board 53 and the cap 51. The driver circuit 52 that generates major heat may be placed on the side of the driver board 54 opposite to the side 54 facing the core column 571.

The welding mud 58 may include resin, glue, oxide zine and other material. It is found that the oxide zine may help heat dissipation, 3% in the total composition would help ensure the necessary effect.

Figure 6:
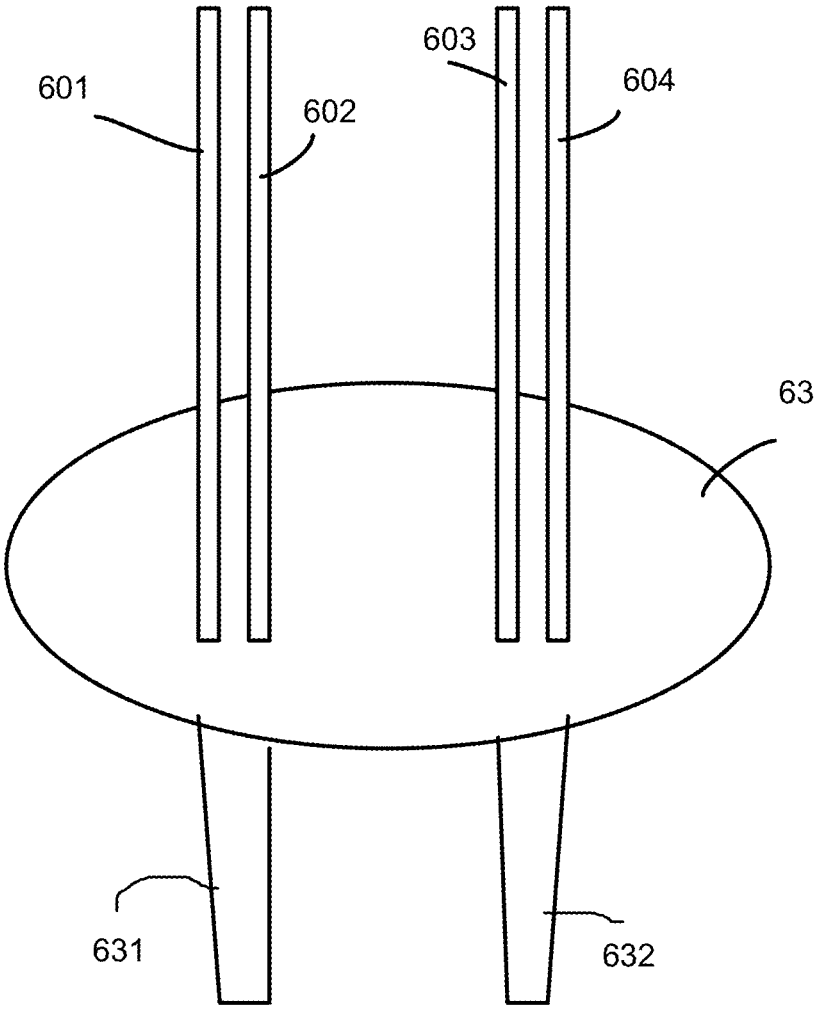
FIG. 6 illustrates an interface unit.

FIG. 6 illustrates an interface unit. In FIG. 6, four power lead wires 601, 602, 603, 604 are integrated by an interface unit 63, with two bottom ends 631, 632 connected to the sockets on the driver board as mentioned above.

Figure 7A:
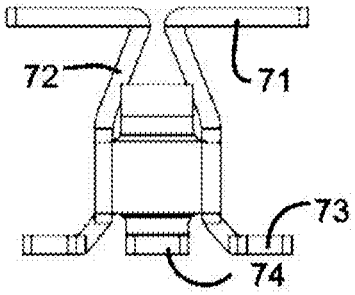
FIG. 7A illustrates an example of a socket.
Figure 7B:
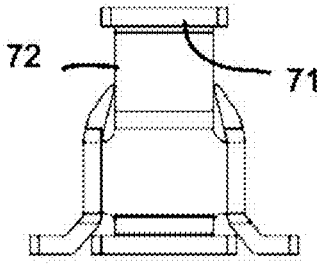
FIG. 7B illustrates another view of the socket in FIG. 7A.
Figure 7C:
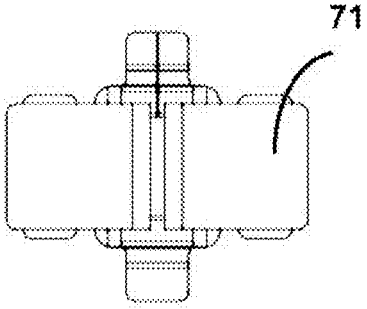
FIG. 7C illustrates another view of the socket in FIG. 7A.
Figure 7D:
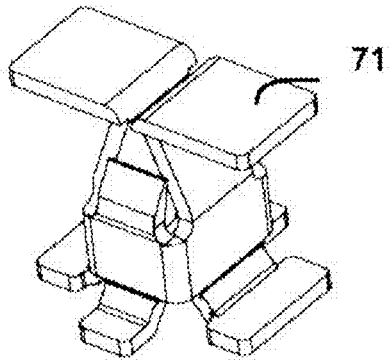
FIG. 7D illustrates another view of the socket in FIG. 7A.

FIG. 7A illustrates an example of a socket. FIG. 7B illustrates another view of the socket in FIG. 7A. FIG. 7C illustrates another view of the socket in FIG. 7A. FIG. 7D illustrates another view of the socket in FIG. 7A. In these drawings, the socket has extended top structures 71 and two arms 72 for receiving power lead wires.

Figure 8A:
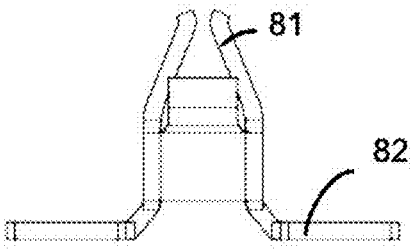
FIG. 8A illustrates an example of a socket.
Figure 8B:
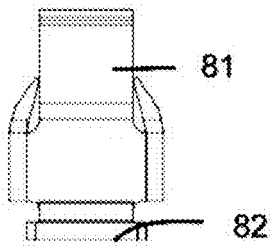
FIG. 8B illustrates another view of the socket in FIG. 8A.
Figure 8C:
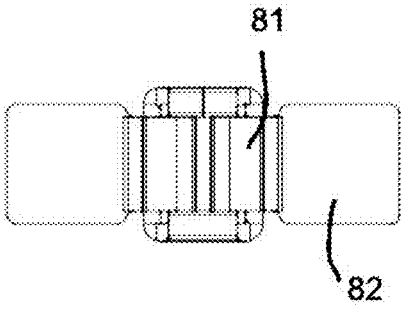
FIG. 8C illustrates another view of the socket in FIG. 8A.
Figure 8D:
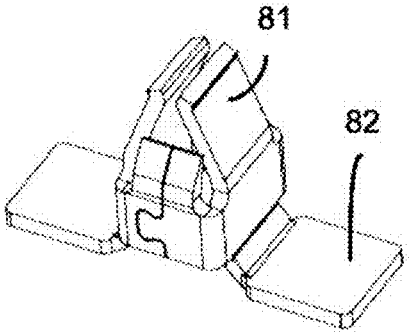
FIG. 8D illustrates another view of the socket in FIG. 8A.

FIG. 8A illustrates an example of a socket. FIG. 8B illustrates another view of the socket in FIG. 8A. FIG. 8C illustrates another view of the socket in FIG. 8A. FIG. 8D illustrates another view of the socket in FIG. 8A. Similar to the example in FIG. 7A, the arm has two arms 81 but without extended structures and two feet 82 to be fixed on the driver board.

According to an embodiment of the present invention, a LED filament bulb apparatus has a bulb shell, at least one LED strip, a core column, two pluggable sockets, a driver board and a cap.

The at least one LED strip is mounted with a LED module. In some embodiments, there is only LED strip and in some other embodiments, there are two or more than two LED strips. Each LED strip may have a substrate, which may be transparent for emitting wide angle light, and multiple LED chips disposed on the substrate connected in series or in other manner, two electrode disposed at two ends of the substrate for supplying a driving current to the LED chips. The substrate may have an elongated shape. The substrate may be transparent, rigid or flexible.

There are various ways to arrange the LED strips. For example, multiple LED strips are arranged as a three-dimension structure in different planes to emit wide angles in a three-dimension space. A metal bar or a pillar may be fixed on the core column extended upwardly to support top ends of the LED strips. Alternatively, a bracket made of metal, glass or plastic material may be fixed on the core column to support the LED strips.

The LED strips may be connected in series or in parallel as a LED strip set. In some other embodiments, the LED strips are divided into two more independent LED strip sets, e.g. for different colors or different color temperatures. In such case, each LED strip set may have its own two power lead wires. In other words, there may be more than two power lead wires disposed in a LED bulb apparatus.

The driver circuit may have corresponding driving modules controlling and serving corresponding LED strip sets. For example, two LED strips with different color temperatures may be supplied with varied combinations of driving current to mix different overall color temperature of the LED bulb apparatus.

The LED strip is directly or indirectly electrically connected to two power lead wires. If there is only LED strip, two ends of the LED strip are connected to the two power lead wires. If there are more than two LED strips, the LED strips are still indirectly electrically connected to the two power lead to receive power supply.

As mentioned above, there may be multiple LED strip sets, and each LED strip may have its own LED power lead wires.

The core column supports the LED strip. The core column is fixed with the bulb shell forming a chamber for containing the LED strip. The two power lead wires have embedded parts embedded in the core column and having bottom ends exposed outside the core column.

The two pluggable sockets respectively receive thus are connected to the two bottom ends of the two power lead wires.

The driver board is used for mounting the two pluggable socket and a driver circuit. The two bottom ends of the two power lead wires are electrically connected to the driver circuit for receiving a driving current generated by the driver circuit from converting an external power source.

The cap is fixed to the core column and the bulb shell has two external electrodes for connecting input of the external power source. For example, the cap is corresponding to a standard Edison bulb socket. When the LED bulb apparatus is screwed into an Edison socket connected to a 110V or 220V power supply, the external power is converted to a driving current sent to the LED strip via the socket and the bottom ends of the power lead wires.

In some embodiments, the pluggable socket is made by folding a metal sheet to form an elastic receiver part and a base part. The base part is structurally fixed on the driver board. The pluggable socket is electrically connected to the driver circuit. The elastic receiver parts respectively clip the bottom ends of the power lead wires. In other words, the driving current is transmitted via the driver circuit, the elastic receiver part of the socket, the bottom end and then to the LED strip.

The elastic receiver parts have elastic force due to material characteristic and structure shape to keep touching and thus electrically connected to the bottom ends of the power lead wires. For example, the elastic receiver parts may be two arms with top ends kept close, providing an entrance for inserting the bottom end of the power lead wire. When the power lead wire is inserted though the entrance, the two arms are stretched and form an elastic force to clip the bottom end of the power lead wire.

The surface of the bottom end and the two arms may be processed to increase better contact and to prevent loose of connection.

When the sheet is folded, the sheet becomes a box shape with two arms mentioned above and four feet to stand and to fix to the circuit board. All four feet may be fixed on the driver board with welding mud or glue. In addition, circuit terminals are electrically connected to the one or more feet to keep the inserted bottom end of the power lead wire electrically connected to the driver circuit.

Furthermore, in some embodiments, the receiver part of the socket may have an entrance track with a top opening, where the bottom end of the power lead wire is entered. The top opening is kept wider than a lower part of the entrance track for guiding the bottom ends entering the entrance track. When the bottom end of the power lead wire has entered the opening, the bottom end of the power lead wire meets a narrower space and finally is clip and fixed in the socket.

Furthermore, in some embodiments, the entrance track has a tilt angle to help fix the bottom end of the power lead wire. In other words, during the insertion of the bottom end of the power lead wire into the socket, part of the bottom end of the power lead wire is bent, which helps increase robust fixing effect between the socket and the bottom end of the power lead wire.

In some embodiments, the receiver part is a pair of elastic clip structures, just like a scissor structure to clip and thus fix the bottom end of the power lead wire.

In some embodiments, the pair of elastic clip structures respectively have extended top structures respectively to increase a top operation area of the socket. With such design, particularly during automatic manufacturing processing, the sockets are easier to be operated by a manufacturing robot and thus the socket may occupy even less size, which may save more cost and decrease manufacturing difficulty, e.g. using less expensive robots to manufacturing such LED bulbs.

In some embodiments, the bottom end of the power lead wire has a first hook structure and the socket has a corresponding second hook structure. When the bottom end of the power lead wire is inserted into a predetermined position of the socket, the first hook structure is hooked with the second hook structure to stabilize connection of the bottom end of the power lead wire and the socket.

For example, the bottom end of the power lead wire may have a protruding block as the first hook structure, which is corresponding a cavity on the socket as the second hook structure. When the protruding block of the bottom end of the power lead wire meets the cavity, the protruding block is kept in the cavity unless an extra external force is applied to escape the protruding block away from the cavity of the socket.

Such corresponding hook structures may be varied to other structures, like a ring to a protruding block or any other structures at a specific position where the bottom end and the socket are expected to be fixed together.

In some embodiments, the core column and the bulb shell are firstly fixed together to form a shell module. The shell module has a bottom surface, and the power lead wires are extended beyond the bottom surface of the shell module with more than 5 mm. In other words, the bottom ends has a protruding portion with respect to the bottom surface of the shell module.

Furthermore, in such case, the driver board may engage the bottom surface after the power wires are inserted into the sockets of the driver board. In other words, the protruding portion of the power lead wires with respect to the bottom surface of the shell module is entered into the socket and stopped when the driver board touches the bottom surface of the shell module.

In some embodiments, the core column and the bulb shell are made of glass material and the core column has an exhaust tube for filling heat dissipation gas into a sealed chamber of the bulb shell and the core column. The heat dissipation gas may be $H_2$, He, $O_2$ and the air pressure may be between 10 Torr to 2000 Torr. There are various glass materials and some are harder than others.

In some embodiments, the power lead wire also includes an interface unit with the two bottom ends extended from a bottom side of the interface unit. The interface unit is placed under the core column.

There are several cases for designing the interface unit. For example, the interface unit may include a plastic body, so that a part of the power lead wire is inserted into the plastic body and positioned by the plastic body so that the two bottom ends of the power lead wires are aligned with the two corresponding sockets on the driver board. In some other examples, the interface unit may further have two metal electrode pins as the two bottom ends mentioned above that are electrically connected and structured connected to the other portion of the power lead wires. Specifically, the power lead wire may be flexible and difficult to insert into the socket directly. By connecting the power lead wire with a pin as the bottom end of the power lead wire, it would be easier to align and to assemble these components together, saving manufacturing difficulty and increasing manufacturing speed.

Furthermore, the interface unit may be a hub for collecting more than two power lead wires with a common output as the bottom end mentioned above. Such arrangement also enhances design convenience for building a more complicated combination of LED strips to meet different LED bulb requirements.

In some embodiments, the interface unit may also be used for keeping the two bottom ends with a predetermined distance to be plugged into the two sockets. Compared with directing inserting the power lead wires into the socket, placing an interface unit with a plastic body or other material, specifically having certain aligning or positioning structures with respect to the cap or the shell module, would help the overall assembling and structure more stable.

In some other embodiments, the sockets may have two sliding tracks for the two bottom ends to insert by rotation the driver board with respect to the interface unit. For example, the bottom ends are inserted into the sliding tracks by rotating the cap with respect to the shell module to fix the bottom ends of the power lead wires to the sockets of the driver board.

In some embodiments, the driver board has two through holes and the two bottom ends are inserted through the two through holes to reach the two sockets. In other words, the sockets are placed at the opposite side of the driver board with respect to the side facing to the core column.

In some embodiments, the two sockets are made as a module to be fixed on the driver board. For example, the two sockets may be made of folded metal sheet and then molded into a plastic unit. The plastic unit is fixed to a corresponding structure on the driver board to fix the sockets on the driver board. Further electricity connection may be made by welding mud or by contacting the socket directly with electrode terminals of the driver circuit with the plastic unit.

In some embodiments, the core column and the bulb shell form a shell module. The cap, the driver board and the shell module are fixed together with a welding mud. The welding mud is firstly mixed with some solution like alcohol liquid and then the LED bulb is heated to remove such solution to fix the cap, the driver board and the shell module together.

Furthermore, the welding mud is applied so as to connect the driver board with the cap and the shell module to transmit heat for performing better heat dissipation. Specifically, a part of the welding mud is clipping and holding the edge of the driver board to take heat of the driver board to other place.

In some embodiments, there are more than two power lead wires, and a portion of the power lead wires are twisted together to enter the same socket. In some design, the power lead wires are twisted or connected in the core column. In some other design, the power lead wires are twisted or connected at the bottom ends of the power lead wires. As mentioned above, there may be multiple LED strips forming multiple LED strip sets. Under certain combination of the LED strips, some power lead wires electrically connected to the same terminal in a circuit diagram may be twisted first. The twisted wires, in some socket, may be easier and provide a better fixing effect to be connect to the socket.

In some embodiments, the driver board have a metal pattern not connected to the driver circuit for enhance heat dissipation. In other words, when manufacturing the driver board using common circuit board material. Some patterns of metal parts, not part of the driver circuit, may be placed specifically for enhancing heat dissipation.

In some embodiments, a circuit component of the driver board that generates most heat is placed on a bottom side of the driver board opposite to a top side facing to the core column. For example, the power IC or bridge circuit may be placed on the bottom side. In such arrangement, the heat is prevented from the LED strip and also the cap helps preventing electro-magnetic wave escape outside the LED bulb.

In some other designs, when the circuit components of the driver circuit are the major heat source, the circuit components are placed on both sides of the driver board. In some design, the connection between the core column and the driver board also helps bring heat generates by the driver circuit to other places of the LED bulb to perform heat dissipation.

The invention claimed is:

1. A LED lighting apparatus, comprising:

a bulb shell;

multiple LED strips mounted with a LED module, wherein the LED strips electrically connected to two power lead wires;

a core column fixed with the bulb shell forming a chamber containing the LED strips, the two power lead wires having embedded parts embedded in the core column and having bottom ends;

two pluggable devices respectively receiving the two bottom ends of the two power lead wires;

a driver board for mounting the two pluggable devices and a driver circuit, the two bottom ends of the two power lead wires being electrically connected to the driver circuit for receiving a driving current generated by the driver circuit from converting an external power source; and a cap for fixing to the core column and the bulb shell having two external electrodes for connecting input of the external power source, wherein the bottom end of the power lead wire has a first plugging structure and the pluggable device has a corresponding second plugging structure, when the bottom end of the power lead wire is inserted into a predetermined position of the pluggable device, the first plugging structure is fixed with the second plugging structure to stabilize connection of the bottom end of the power lead wire and the pluggable device.

2. The LED lighting apparatus of claim 1, wherein the pluggable device is made by folding a metal sheet to form an elastic receiver part and a base part, the base part is structurally fixed on the driver board and electrically connected to the driver circuit, the elastic receiver parts respectively clip the bottom ends of the power lead wires.

3. The LED lighting apparatus of claim 2, wherein the receiver part defines an entrance track with a top opening wider than a lower part of the entrance track for guiding the bottom ends entering the entrance track.

4. The LED lighting apparatus of claim 3, wherein the entrance track has a tilt angle to help fix the bottom end of the power lead wire.

5. The LED lighting apparatus of claim 2, wherein the receiver part is a pair of elastic clip structures.

6. The LED lighting apparatus of claim 5, wherein the pair of elastic clip structures respectively have extended top structures respectively to increase a top operation area of the socket.

7. The LED lighting apparatus of claim 1, wherein the core column and the bulb shell forms a shell module, the shell module has a bottom surface, and the power lead wires extended beyond the bottom surface of the shell module with more than 5 mm.

8. The LED lighting apparatus of claim 7, the driver board touches the bottom surface after the power lead wires are inserted into the sockets.

9. The LED lighting apparatus of claim 1, wherein the core column and the bulb shell are made of glass material and the core column has an exhaust tube for filling heat dissipation gas into a sealed chamber of the bulb shell and the core column.

10. The LED lighting apparatus of claim 1, wherein the power lead wire comprises an interface unit with the two bottom ends extended from a bottom side of the interface unit, the interface unit is placed under the core column.

11. The LED lighting apparatus of claim 10, wherein the interface unit keeps the two bottom ends having a predetermined distance to be plugged into the two sockets.

12. The LED lighting apparatus of claim 10, wherein the sockets have two sliding tracks for the two bottom ends to insert by rotation the driver board with respect to the interface unit.

13. The LED lighting apparatus of claim 1, wherein the driver board has two through holes and the two bottom ends are inserted through the two through holes to reach the two sockets.

14. The LED lighting apparatus of claim 1, wherein the two sockets are made as a module to be fixed on the driver board.

15. The LED lighting apparatus of claim 1, wherein the core column and the bulb shell form a shell module, the cap, the driver board and the shell module are fixed together with a welding mud.

16. The LED lighting apparatus of claim 15, wherein the welding mud transmits heat among the driver board, the shell module, and the cap.

17. The LED lighting apparatus of claim 1, wherein there are more than two power lead wires, a portion of the power lead wires are twisted together to enter the same socket.

18. The LED lighting apparatus of claim 1, wherein the driver board have a metal pattern not connected to the driver circuit for enhance heat dissipation.

19. The LED lighting apparatus of claim 1, wherein a circuit component generating most heat is placed on a bottom side of the driver board opposite to a top side facing to the core column.

* * * * *